US005897466A

United States Patent [19]

Capach

[11] Patent Number: 5,897,466

[45] Date of Patent: Apr. 27, 1999

[54] HEAVY BAG AND SUPPORT MECHANISM

[76] Inventor: James F. Capach, 309 Homestead Ave., Maybrook, N.Y. 12543

[21] Appl. No.: 08/988,656

[22] Filed: Dec. 11, 1997

[51] Int. Cl.[6] ..... A63B 69/34

[52] U.S. Cl. ..... 482/83; 473/443; 482/87; 482/90

[58] Field of Search ..... 482/83–90; 473/441–445

[56] References Cited

U.S. PATENT DOCUMENTS

| | | | |
|---|---|---|---|
| 2,183,465 | 12/1939 | Noor | 473/443 |
| 2,255,711 | 9/1941 | Noor | 473/443 |
| 3,424,458 | 1/1969 | Hoops, Jr. | 473/443 |
| 3,547,438 | 12/1970 | Schmitter | 473/443 |
| 3,637,210 | 1/1972 | Brantley | 473/443 |
| 4,911,428 | 3/1990 | Wiece | 473/442 |

*Primary Examiner*—Jerome Donnelly

[57] ABSTRACT

A new heavy bag and support mechanism for allowing a bag to move in a variety of ways after being struck. The inventive device includes a support beam having an I-shaped cross-section. A swiveling rail support is coupled to the support beam. A rolling assembly is slidably coupled with the support beam. A height adjustment tube is swively secured to the rolling assembly. A heavy bag is provided having a wide upper portion and a narrow lower portion. An upper surface of the wide upper portion is swively coupled with a free end of the height adjustment tube.

14 Claims, 2 Drawing Sheets

HEAVY BAG AND SUPPORT MECHANISM

BACKGROUND OF THE INVENTION

1. Field of the Invention

The present invention relates to exercise devices and more particularly pertains to a new heavy bag and support mechanism for allowing a bag to move in a variety of ways after being struck.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 5,224,912 to Moody; U.S. Pat. No. 4,911,428 to Wiece; U.S. Pat. No. 5,048,822 to Murphy; U.S. Pat. No. 4,216,957 to Curatola; U.S. Pat. No. 4,345,755 to Eidson; and U.S. Pat. No. Des. 325,233 to Brunette.

While these devices fulfill their respective, particular objectives and requirements, the aforementioned patents do not disclose a new heavy bag and support mechanism. The inventive device includes a support beam having an I-shaped cross-section. A swiveling rail support is coupled to the support beam. A rolling assembly is slidably coupled with the support beam. A height adjustment tube is swively secured to the rolling assembly. A heavy bag is provided having a wide upper portion and a narrow lower portion. An upper surface of the wide upper portion is swively coupled with a free end of the height adjustment tube.

In these respects, the heavy bag and support mechanism according to the present invention substantially departs from the conventional concepts and designs of the prior art, and in so doing provides an apparatus primarily developed for the purpose of allowing a bag to move in a variety of ways after being struck.

SUMMARY OF THE INVENTION

In view of the foregoing disadvantages inherent in the known types of exercise devices now present in the prior art, the present invention provides a new heavy bag and support mechanism construction wherein the same can be utilized for allowing a bag to move in a variety of ways after being struck.

The general purpose of the present invention, which will be described subsequently in greater detail, is to provide a new heavy bag and support mechanism apparatus and method which has many of the advantages of the exercise devices mentioned heretofore and many novel features that result in a new heavy bag and support mechanism which is not anticipated, rendered obvious, suggested, or even implied by any of the prior art exercise devices, either alone or in any combination thereof.

To attain this, the present invention generally comprises a support beam having an I-shaped cross-section. The support beam has a wide central portion and outwardly tapering end portions. The support beam is further defined by an upper horizontal portion, a lower horizontal portion and a vertical portion disposed therebetween. A swiveling rail support is secured to the upper horizontal portion of the support beam. The rail support includes a circular base secured to the upper horizontal portion at the wide central portion. A vertical support pipe extends upwardly from the circular base. The vertical support pipe has a securement collar disposed on a free end thereof. The securement collar is securable to an overhead structure. A swiveling bearing is disposed between the circular base and the upper horizontal portion of the support beam to facilitate rotation of the support beam with respect to the rail support. A rolling assembly is slidably coupled with the lower horizontal portion of the support beam. The rolling assembly includes a U-shaped housing. The U-shaped housing has two pairs of upper wheels and two pairs of lower wheels extending inwardly from opposed vertical members of the housing. The upper wheels are positioned in contact with an upper surface of the lower horizontal portion and the lower wheels are positioned in contact with a lower surface of the lower horizontal portion. A height adjustment tube is swively secured to the rolling assembly. The height adjustment tube includes an upper tube swively coupled with a horizontal extent of the U-shaped housing of the rolling assembly. The upper tube adjustably receives a lower tube therein. A heavy bag is provided having a wide upper portion and a narrow lower portion. An upper surface of the wide upper portion is swively coupled with a free end of the lower tube of the height adjustment tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heavy bag and support mechanism apparatus and method which has many of the advantages of the exercise devices mentioned heretofore and many novel features that result in a new heavy bag and support mechanism which is not anticipated, rendered obvious, suggested, or even implied by any of the prior art exercise devices, either alone or in any combination thereof.

It is another object of the present invention to provide a new heavy bag and support mechanism which may be easily and efficiently manufactured and marketed.

It is a further object of the present invention to provide a new heavy bag and support mechanism which is of a durable and reliable construction.

An even further object of the present invention is to provide a new heavy bag and support mechanism which is susceptible of a low cost of manufacture with regard to both materials and labor, and which accordingly is then susceptible of low prices of sale to the consuming public, thereby making such heavy bag and support mechanism economically available to the buying public.

Still yet another object of the present invention is to provide a new heavy bag and support mechanism which provides in the apparatuses and methods of the prior art some of the advantages thereof, while simultaneously overcoming some of the disadvantages normally associated therewith.

Still another object of the present invention is to provide a new heavy bag and support mechanism for allowing a bag to move in a variety of ways after being struck.

Yet another object of the present invention is to provide a new heavy bag and support mechanism which includes a support beam having an I-shaped cross-section. A swiveling rail support is coupled to the support beam. A rolling assembly is slidably coupled with the support beam. A height adjustment tube is swively secured to the rolling assembly. A heavy bag is provided having a wide upper portion and a narrow lower portion. An upper surface of the wide upper portion is swively coupled with a free end of the height adjustment tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
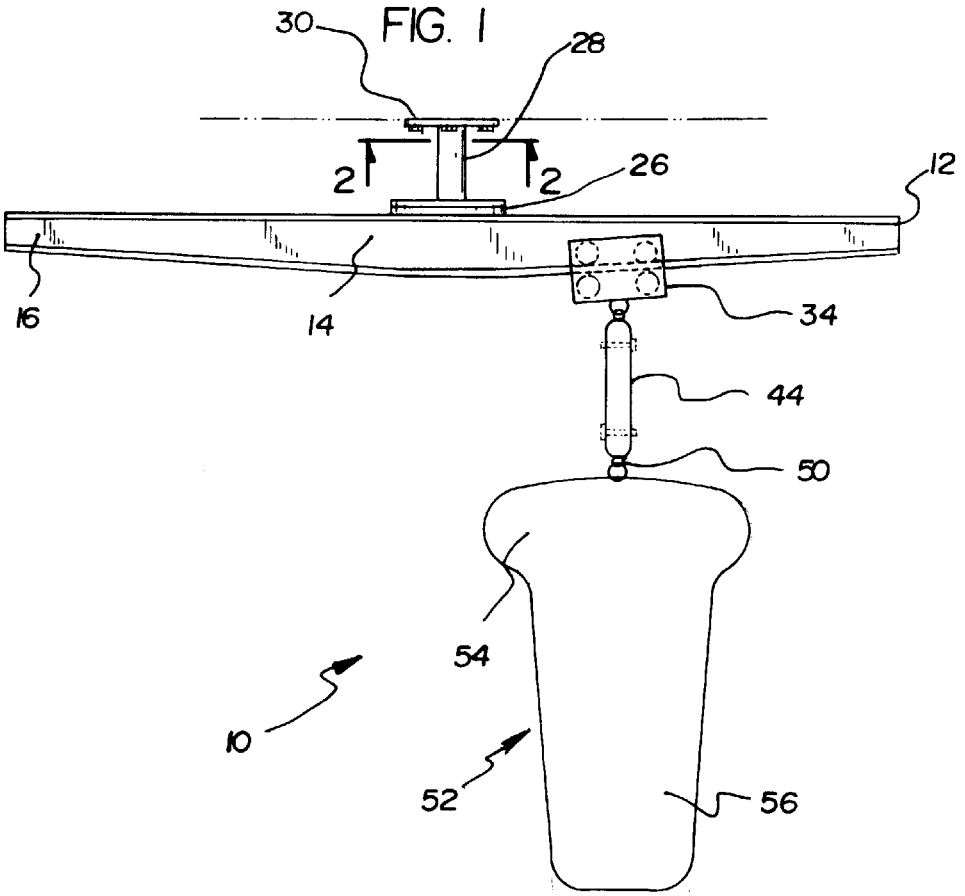
FIG. 1 is a side view of a new heavy bag and support mechanism according to the present invention.
Figure 2:
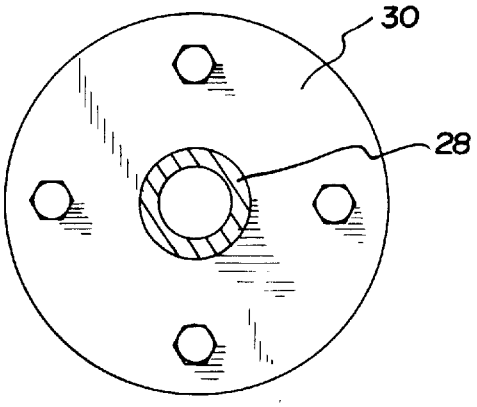
FIG. 2 is a cross-sectional view of the present invention as taken along line 2—2 of FIG. 1.
Figure 3:
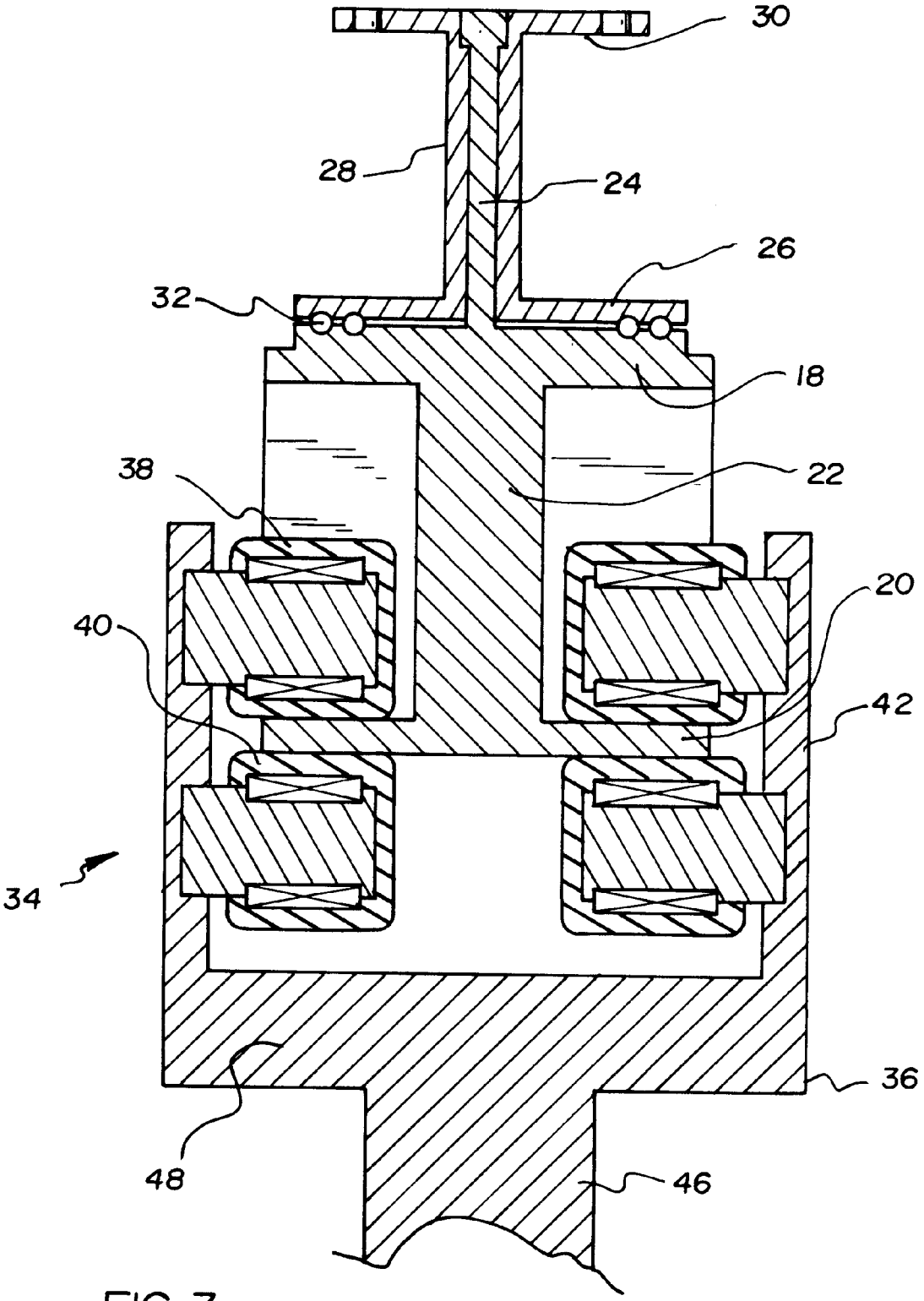
FIG. 3 is a cross-sectional view of the present invention as taken along line 3—3 of FIG. 1.

With reference now to the drawings, and in particular to FIGS. 1 through 3 thereof, a new heavy bag and support mechanism embodying the principles and concepts of the present invention and generally designated by the reference numeral 10 will be described.

As best illustrated in FIGS. 1 through 3, the heavy bag and support mechanism 10 comprises a support beam 12 having an I-shaped cross-section. The support beam 12 has a wide central portion 14 and outwardly tapering end portions 16. The support beam 12 is further defined by an upper horizontal portion 18, a lower horizontal portion 20 and a vertical portion 22 disposed therebetween. The upper horizontal portion 18 has a stem 24 extending upwardly therefrom at the wide central portion 14.

A swiveling rail support is coupled to stem 24 of the upper horizontal portion 18 of the support beam 12. The rail support includes a circular base 26 rotatably coupled to the stem 24 of the upper horizontal portion 18. A vertical support pipe 28 extends upwardly from the circular base 26 and surrounds the stem 24. The vertical support pipe 28 has a securement collar 30 disposed on a free end thereof. The securement collar 30 is securable to an overhead structure. A swiveling bearing 32 is disposed between the circular base 26 and the upper horizontal portion 18 of the support beam 12 to facilitate rotation of the support beam 12 with respect to the rail support. The swivel bearing 32 allows the support beam 12 to freely rotate 360 degrees.

A rolling assembly 34 is slidably coupled with the lower horizontal portion 20 of the support beam 12. The rolling assembly 34 includes a U-shaped housing 36. The U-shaped housing 36 has two pairs of upper wheels 38 and two pairs of lower wheels 40 extending inwardly from opposed vertical members 42 of the housing 36. The upper wheels 38 are positioned in contact with an upper surface of the lower horizontal portion 20 and the lower wheels 40 are positioned in contact with a lower surface of the lower horizontal portion 20. The tapering of the support beam 12 will preclude the rolling assembly 34 from disengaging from the support beam 12.

A height adjustment tube 44 is swively secured to the rolling assembly 34. The height adjustment tube 44 includes an upper tube 46 swively coupled with a horizontal extent 48 of the U-shaped housing 36 of the rolling assembly 34. The upper tube 46 adjustably receives a lower tube 50 therein.

A heavy bag 52 is provided having a wide upper portion 54 and a narrow lower portion 56. An upper surface of the wide upper portion 54 is swively coupled with a free end of the lower tube 50 of the height adjustment tube 44.

In use, when the heavy bag 52 is struck, it would move to a new position before the next strike. This would simulate a fighting environment which previously would have been possible only with another person.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heavy bag and support mechanism for allowing a bag to move in a variety of ways after being struck comprising, in combination:

a generally horizontally oriented support beam having an I-shaped cross-section, the support beam having a central portion and end portions extending outwardly from the central portion, the support beam being further defined by an upper flange, a lower flange and a vertical web portion disposed therebetween, the upper flange having a stem extending upwardly therefrom at the central portion, the lower flange of each of the outwardly tapering end portions tapering upwardly towards the upper flange of each of the outwardly tapering end portions along lengths thereof from the central portion to outer ends thereof;

a swiveling rail support coupled to the stem of the upper flange of the support beam, the rail support including a circular base rotatably coupled to the stem of the upper flange at the central portion, a vertical support pipe extending upwardly from the circular base and surrounding the stem, the vertical support pipe having a securement collar disposed on a free end thereof, the securement collar being securable to an overhead structure, a swiveling bearing disposed between the circular base and the upper flange of the support beam to facilitate rotation of the support beam with respect to the rail support;

a rolling assembly slidably coupled with the lower flange of the support beam, the rolling assembly including a U-shaped housing, the U-shaped housing having two pairs of upper wheels and two pairs of lower wheels extending inwardly from opposed vertical members of the housing, the upper wheels being positioned in contact with an upper surface of the lower flange and the lower wheels being positioned in contact with a lower surface of the lower flange;

a height adjustment tube swively secured to the rolling assembly, the height adjustment tube including an upper tube swively coupled with a horizontal extent of the U-shaped housing of the rolling assembly, the upper tube adjustably receiving a lower tube therein; and a heavy bag having a upper portion and a narrow lower portion, an upper surface of the upper portion being swively coupled with a free end of the lower tube of the height adjustment tube.

2. A heavy bag and support mechanism for allowing a bag to move in a variety of ways after being struck comprising, in combination:

a support beam having an I-shaped cross-section, the support beam having a central portion and end portions extending outwardly from the central portion, the support beam being further defined by an upper flange, a lower flange and a vertical web portion disposed therebetween, the upper flange having a stem extending upwardly therefrom at the central portion, the lower flange of each of the outwardly tapering end portions tapering upwardly towards the upper flange of each of the outwardly tapering end portions along lengths thereof from the central portion to outer ends thereof;

a generally horizontally oriented support beam having an I-shaped cross-section the support beam having a central portion and end portions extending outwardly from the central portion, the support beam being further defined by an upper flange, a lower flange and a vertical web portion disposed therebetween, the upper flange having a stem extending upwardly therefrom at the central portion, the lower flange of each of the outwardly tapering end portions tapering upwardly towards the upper flange of each of the outwardly tapering end portions along lengths thereof from the central portion to outer ends thereof;

a rolling assembly slidably coupled with the support beam;

a height adjustment tube swively secured to the rolling assembly; and a heavy bag having a upper portion and a narrow lower portion, an upper surface of the upper portion being swively coupled with a free end of the height adjustment tube.

3. A heavy bag and support mechanism for allowing a bag to move in a variety of ways after being struck comprising, in combination:

a support beam having an I-shaped cross-section, the support beam having a central portion and outwardly tapering end portions;

a swiveling rail support coupled to the support beam;

a rolling assembly slidably coupled with the support beam;

a height adjustment tube swively secured to the rolling assembly; and a heavy bag having a upper portion and a narrow lower portion, an upper surface of the upper portion being swively coupled with a free end of the height adjustment tube.

4. The heavy bag and support mechanism as set forth in claim 2 wherein the support beam is further defined by an upper flange, a lower flange and a vertical portion disposed therebetween, the upper flange having a stem extending upwardly therefrom at the central portion.

5. The heavy bag and support mechanism as set forth in claim 4 wherein the swiveling rail support is coupled to the stem of the upper flange of the support beam.

6. The heavy bag and support mechanism as set forth in claim 5 wherein the rail support includes a circular base rotatably coupled to the stem of the upper flange at the central portion, a vertical support pipe extending upwardly from the circular base and surrounding the stem, the vertical support pipe having a securement collar disposed on a free end thereof, the securement collar being securable to an overhead structure, a swiveling bearing disposed between the circular base and the upper flange of the support beam to facilitate rotation of the support beam with respect to the rail support.

7. The heavy bag and support mechanism as set forth in claim 6 wherein the rolling assembly is slidably coupled with the lower flange of the support beam, the rolling assembly including a U-shaped housing, the U-shaped housing having two pairs of upper wheels and two pairs of lower wheels extending inwardly from opposed vertical members of the housing, the upper wheels being positioned in contact with an upper surface of the lower flange and the lower wheels being positioned in contact with a lower surface of the lower flange.

8. The heavy bag and support mechanism as set forth in claim 7 wherein the height adjustment tube includes an upper tube swively coupled with a horizontal extent of the U-shaped housing of the rolling assembly, the upper tube adjustably receiving a lower tube therein.

9. The heavy bag and support mechanism as set forth in claim 2 wherein the support beam is further defined by an upper flange, a lower flange and a vertical portion disposed therebetween, the upper flange having a stem extending upwardly therefrom at the central portion.

10. The heavy bag and support mechanism as set forth in claim 9 wherein the swiveling rail support is coupled to the stem of the upper flange of the support beam.

11. The heavy bag and support mechanism as set forth in claim 10 wherein the rail support includes a circular base rotatably coupled to the stem of the upper flange at the central portion, a vertical support pipe extending upwardly from the circular base and surrounding the stem, the vertical support pipe having a securement collar disposed on a free end thereof, the securement collar being securable to an overhead structure, a swiveling bearing disposed between the circular base and the upper flange of the support beam to facilitate rotation of the support beam with respect to the rail support.

12. The heavy bag and support mechanism as set forth in claim 11 wherein the rolling assembly is slidably coupled with the lower flange of the support beam, the rolling assembly including a U-shaped housing, the U-shaped housing having two pairs of upper wheels and two pairs of lower wheels extending inwardly from opposed vertical members of the housing, the upper wheels being positioned in contact with an upper surface of the lower flange and the lower wheels being positioned in contact with a lower surface of the lower flange.

13. The heavy bag and support mechanism as set forth in claim 12 wherein the height adjustment tube includes an upper tube swively coupled with a horizontal extent of the U-shaped housing of the rolling assembly, the upper tube adjustably receiving a lower tube therein.

14. The heavy bag and support mechanism as set forth in claim 2 and further comprising a swiveling rail support coupled to the support beam.

* * * * *